United States Patent [19]

Bohne et al.

[11] 4,167,889

[45] Sep. 18, 1979

[54] DOUBLE ARMOR PLATE CONSTRUCTION

[75] Inventors: Hans Böhne, Eikamp; Martin Brandt, Hamburg; Artur Butterweck, Hagen, all of Fed. Rep. of Germany

[73] Assignee: Clouth Gummiwerke Aktiengesellschaft, Cologne, Fed. Rep. of Germany

[21] Appl. No.: 613,860

[22] Filed: Sep. 16, 1975

[51] Int. Cl.[2] ..... F41H 5/04

[52] U.S. Cl. ..... 89/36 A

[58] Field of Search ..... 89/36 A

[56] References Cited

FOREIGN PATENT DOCUMENTS 2324724 11/1974 Fed. Rep. of Germany ..... 89/361 A

*Primary Examiner*—Stephen C. Bentley

*Attorney, Agent, or Firm*—Becker & Becker, Inc.

[57] ABSTRACT

A double armor plate construction, especially for the housing of armored vehicles, with inner and outer armor plates and with elastic buffers therebetween, distributed over the inside of the armor plates. The buffers consist primarily of natural or synthetic rubber material and have a substantially cylindrical shape. One end of the buffers is connected to a base plate fastened to the inner armor plate, whereas the other end of the buffers is respectively connected to adjacent holding screws extending through the outer armor plate. The holding screws are threadedly connected to bushings within the buffers so that the buffers are secured against movements in the axial direction thereof and transverse thereto. The bushings are provided with inner partially elastic metallic reinforcements which absorb thrust forces, especially those transverse to the central longitudinal axes of said buffers.

11 Claims, 7 Drawing Figures

2
10
11
12
9
5b
5a
3

1
2
7
13
12

1
2
14
10
6
8
7
9
5
13
12
11
3

1
2
13
12
7

DOUBLE ARMOR PLATE CONSTRUCTION

The present invention relates to a double armor plating, especially for the housing of armored vehicles with inner and outer armor plating between which, distributed over the plating surface elastic buffers are arranged which are connected to the two plates of armor.

With a heretofore known armor plating of the above mentioned type, steel spring buffers under preload are inserted between the armor plates which are displaceably held together by means of bolts. When the outer armored plate is hit at an acute or obtuse angle by a projectile, the shearing forces resulting therefrom are only incompletely absorbed by the bolts. Furthermore, the loosely inserted springs must be preloaded during the assembly which requires considerable work. Furthermore, an expensive holding and spring system separate from each other is necessary. An arrangement of this type is described in U.S. Pat. No. 1,273,515. It is furthermore known as elastic holding members for the outer armor plate to employ rubber rails which extend all the way along the edges of the armor plates. These rails are connected to the inner armor plate nearly at one plate edge and more specifically in such a way that primarily under shearing stresses exerted upon the rubber rails, the outer armor plate is pivotable toward the inner armor plate in response to an impact by a projectile. Furthermore, the pivoting movement is limited by elastic rubber buffers. With this known design, only the outer armor plate held on one edge only is already by the movement of the vehicle exposed to continuous vibrations which prematurely destroy the rubber.

It is a well-known fact that when the armored vehicle is hit by a projectile, the outer armor plate is always damaged. Therefore, it is necessary after completion of the respective fighting action to exchange said outer armor plate. A fast and easy exchange of the outer armor plate, for instance with the change in ammunition in the course of the life of the armored vehicle, is necessary also when an existing vehicle having only one armor plate is to be equipped with a better outer armor plate for protection.

It is, therefore, an object of the present invention to provide an armor plating according to which a simple holding arrangement is assured which even with projectiles hitting the vehicle at an acute angle will still have an elastically cushioning effect while supporting the outer armor plate.

It is still another object of this invention to provide an armor plating which can easily and quickly be exchanged.

Figure 1:
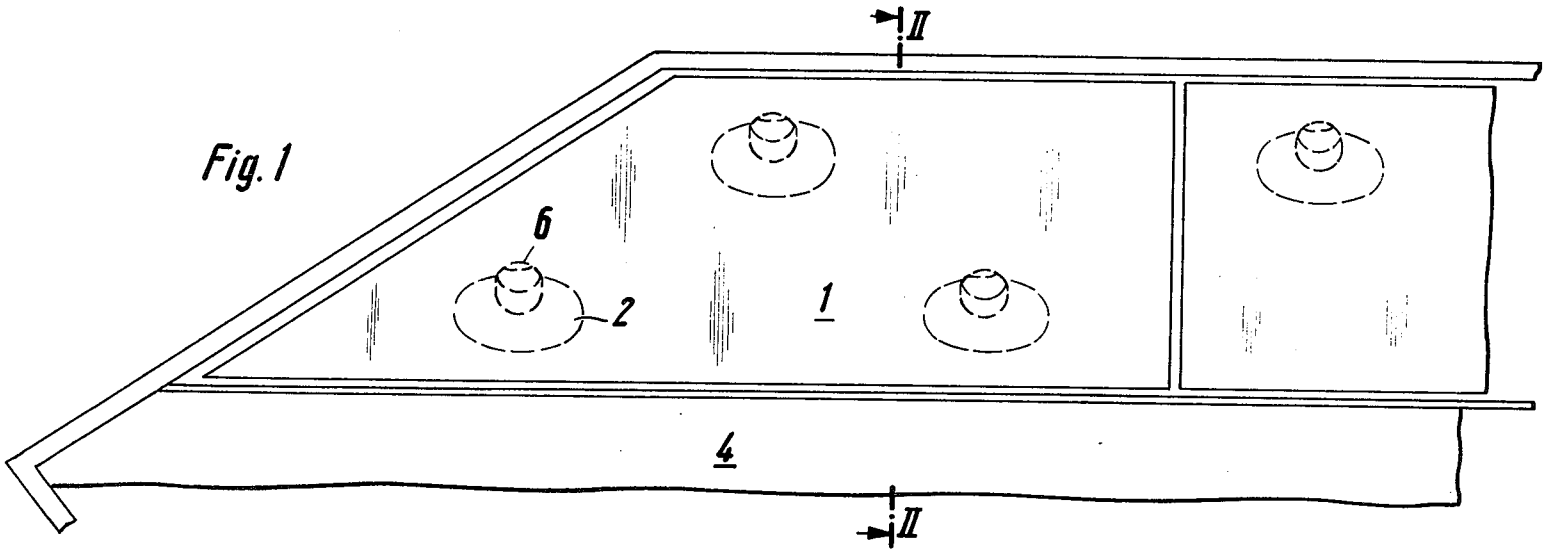

These and other objects and advantages of the invention will appear more clearly from the following specification in connection with the accompanying drawings, in which:

FIG. 1 diagrammatically illustrates a portion of an armored car construction with the armor plating according to the invention.

Figure 2A:
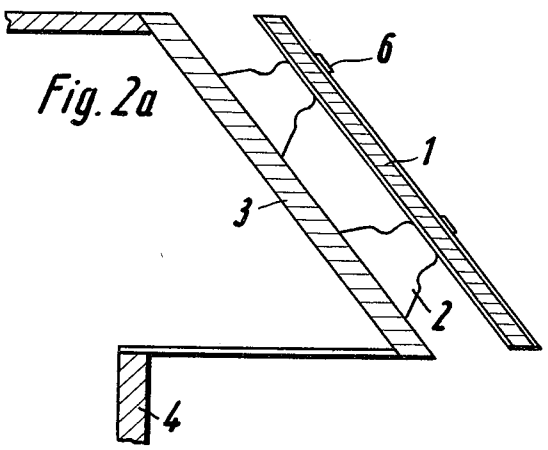
Figure 2:
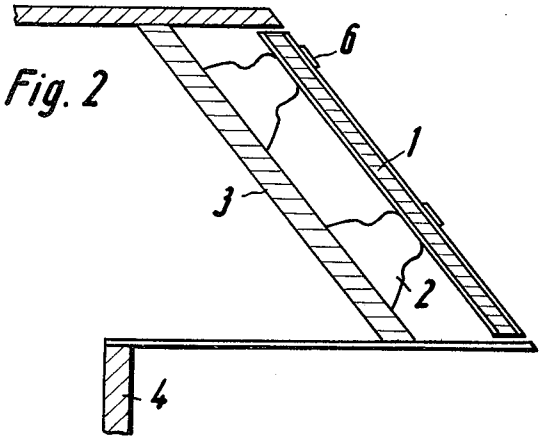

FIG. 2 represents a section taken along the line II—II of FIG. 1 with an arrangement of the armor plates in conformity with the present invention.

FIG. 2*a* is a section similar to that of FIG. 2 but with the outer armor plate applied to an armored vehicle originally having only one armor plate.

Figure 3A:
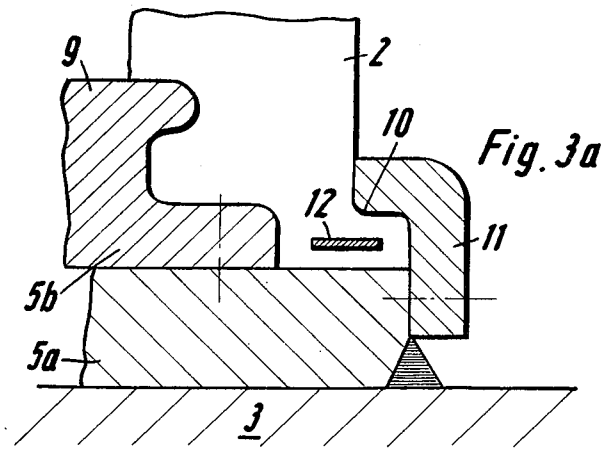
Figure 3:
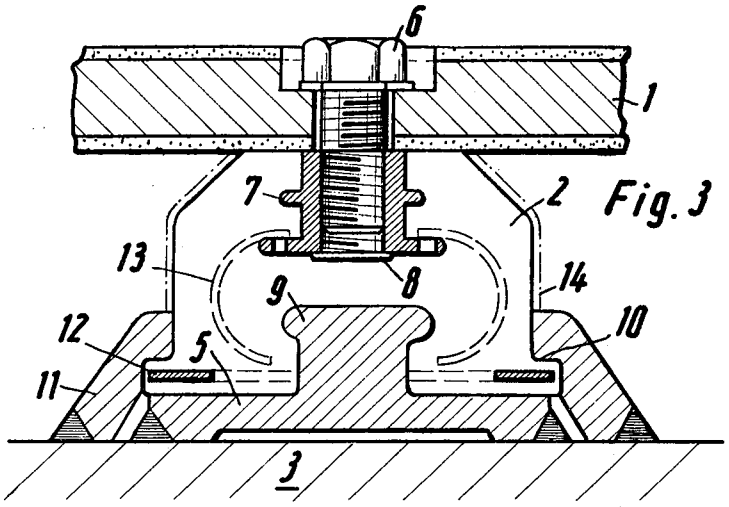

FIG. 3 illustrates the shape and arrangement of a rubber buffer with welded-on screw collar ring in conformity with the present invention.

FIG. 3*a* illustrates a partial view similar to that of FIG. 3 but with screwed-on screw collar ring.

Figure 5:
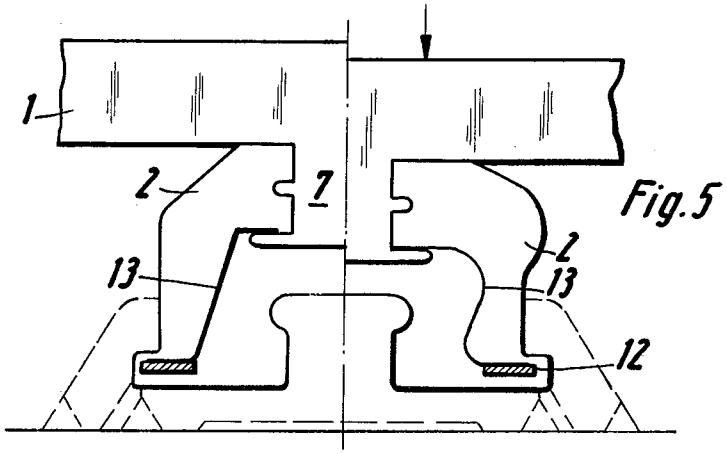
Figure 4:
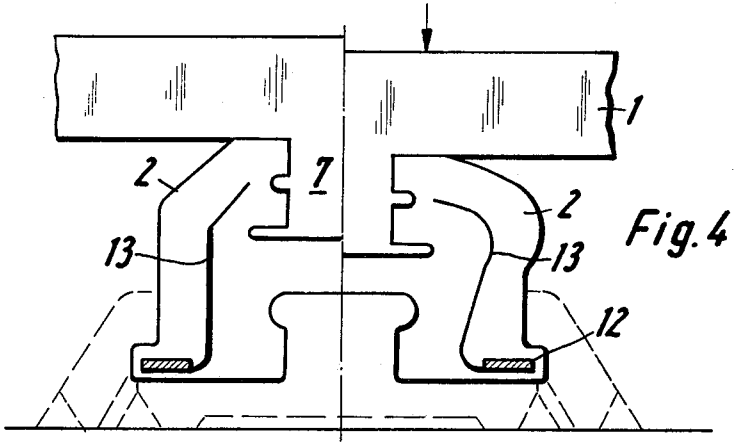

FIGS. 4 and 5 diagrammatically illustrate the rubber buffer according to FIG. 1 with different elastic metal reinforcing elements in axially non-compressed condition on the lefthand side of FIGS. 4 and 5 and an axially compressed condition on the righthand side of FIGS. 4 and 5.

The armor double plate according to the present invention is characterized primarily in that the elastic buffers which are arranged between the two armor plates, consist of rubber material and have a substantially cylindrical shape while one end of said buffers is positively connected to a base plate which is connected to the inner armor plate, whereas the other end of said buffers is by means of a threaded bushing receiving a holding screw which extends to the outer armor plate positively secured against movements in the direction of the cylinder axis and transverse thereto and is provided with inner partially elastic metallic reinforcements for in particular absorbing shearing forces occurring in the direction transverse to the cylinder axis of the buffer.

In view of this design and this connection of the buffers, the exchangeability of the outer armor plate is easily effected by loosening a holding screw which means that the processing and machineability of the outer armor plate need not be taken into consideration. Thus, steels which are particularly favorable for the protection intended but are normally neither suitable for mechanical machining nor for welding, after having been heat treated, can, without difficulty, be used in the present invention. The elastic metallic reinforcements, for instance in the form of steel wires, which are provided inside the rubber buffers serve for absorbing shearing forces acting in a direction transverse to the cylinder axis. This means that the elasticity of the reinforcements is intended above all to act in response to stresses which occur in the direction parallel to the cylinder axis. The change in the shape of the reinforcements should as far as possible correspond to that of the rubber material so that the rubber stiffness which by itself is sufficient in the direction parallel to the cylinder axis, will not unnecessarily be increased.

According to a further development of the invention, the rubber buffers are by means of a recess adapted by sliding means to be pressed upon a mushroom-shaped portion of the base plate. In this way, an easy replacement of possibly damaged rubber buffers is possible, and the manufacture of the rubber bodies is simpler. Moreover, the base plate can without the danger of the influences of heat upon the rubber bodies be welded onto the inner armor plate.

The costs of manufacture are additionally reduced by the fact that each mushroom-shaped part is provided with a flange and by means of the latter is screwed onto the base plate.

In order still further to improve the connection of the rubber buffers with the inner armor plate and to support the rubber buffers also laterally, the rubber buffers are, according to a further development of the invention reinforced within the region of the base plate by a flange-like extension for a screw collar ring. The screw collar ring is adapted to be screwed onto the base plate or is adapted to be welded to the inner armor plate.

If desired, in the flange-shaped extension there may be provided a flat metal ring cooperating with the screw roller ring. The metal ring may by itself be formed into the rubber mass, or the metal ring may be operatively connected to the metal reinforcements for absorbing the shearing forces so that the individual elements of the metal reinforcements will be held together.

As element of the metal reinforcement there may be provided leaf springs which are coaxially arranged with the cylinder axis. The leaf spring surfaces should face the cylinder axis which means the change in shape of said leaf springs should act exclusively in radial direction.

The metal reinforcement results in a particularly advantageous cushioned transfer of the shearing forces from the outer to the inner armor plate when the leaf springs engage the threaded bushing and in spaced relationship surround the mushroom-shaped portion of the base plate in a bell-shaped manner or semi-spherical manner.

When in, contrast to the just mentioned design, the leaf springs are not connected to the flat metal ring, they may individually be formed into the rubber buffers or may form a spring cage in which instance the cage, similar to a ball bearing cage, merely serves to hold together the reinforcing elements aligned relative to each other. In other words, a prefabricated spring cage with the threaded bushing is screwed onto an additional non-illustrated outer thread and in this way is connected to the bushing. Of course, also a corresponding bayonet joint would be possible. If finally, according to the invention, the rubber buffers are conical within the region of the threaded bushing, it will be possible by the selection of the cone in cooperation with the rubber quality to change the deformation of the rubber buffer in conformity with the deformation of the reinforcing elements.

Referring now to the drawings in detail, the outer armor plate 1 is by the rubber buffers 2 held in spaced relationship to the inner armor plate 3 of the armor housing 4. Welded by means of a cage onto the inner armor plate 3 is a base plate 5 which by means of a mushroom-shaped part 9 extends into the rubber buffers 2. The rubber buffer 2 is by sliding means forced upon the mushroom-shaped part 9 of the base plate 5 or is pressed thereon (depending on the size). Each rubber buffer 2 at that end thereof which faces away from the inner armor plate 1 surrounds a cast-in threaded bushing 7 which should have a relatively large surface and should be well rounded. The threaded bushing 7 is flush with the rubber buffer 2 and thus forms the engaging surface for the outer armor plate 1. A holding screw 6 the head of which, with sufficient thickness of the outer armor plate 1, may be entirely or partially countersunk and connects the outer armor plate 1 to the threaded bushing 7, the bore of which is closed relative to the buffer 2 by a disc 8. The rubber buffer 2 has at that end thereof which faces the inner armor plate 3 a circular flange-shaped extension 10 over which extends a screw collar ring 11 which may be connected to the inner armor plate 3 or the base plate 5. The connection to the inner armor plate is effected by welding. The screw connection to the base plate 5 according to FIG. 3*a* has the advantage that it affords an easy exchange of the rubber buffers 2 without the danger of distortion or destruction by the welding heat. The screw connection may also be effected by means of a circumferential thread. The screw connection in one or the other manner referred to above is sometimes also determined by local conditions. However, (see FIG. 3*a* the mushroom-shaped part 9 may be provided with a flange 5*b* which by means of screws is connected to the base plate 5*a*.

For purposes of distributing the holding forces exerted by the screw collar ring 11 onto the flange-shaped extension 10 of the rubber buffer 2, over a larger surface of the rubber buffer 2, when a projectile hitting the outer armor plate 1 at an acute or obtuse angle, initiates a tilting movement of the buffer 2 there is embedded in the flange-shaped extension 10 a non-elastic flat metal ring 12 which partially extends into the rubber buffer 2 proper.

The reference numeral 13 designates the elastic inner metal reinforcements which are intended to increase the resistance of the rubber buffer 2 atainst shearing forces acting in a direction transverse to the cylinder axis x—x, without impeding the cushioning deformation of the rubber buffer 2 when forces occur which act in axial direction or at an angle thereto. Shearing forces acting transverse to the cylinder axis occur when a projectile hits the outer armor plate 1 at an acute or obtuse angle. The metal reinforcing elements 13 may without being connected to each other or to other parts be held only by the rubber material surrounding the same or may be connected to the flat metal ring 12 or to the threaded bushing 7 by screws or by welding or may form one piece therewith.

The reinforcing elements 13 must be elastic and must be able when subjected to pressure to deform similar to rubber material. The reinforcing elements 13 may without outer forces or stresses surround the threaded bushing 7 and the mushroom-shaped part 9 in the form of a cone, a bell or a ring, the cross section of which corresponds to a semi-circle open toward the inside. The reference numeral 14 designates a non-burnable outer coating of the rubber buffers 2.

Practical tests have shown that the armor structure according to the invention has shown a full success with all calibers.

It is, of course, to be understood that the present invention is, by no means, limited to the specific showing in the drawings, but also comprises any modifications within the scope of the appended claims.

What we claim is:

1. A double armor plate construction, especially for the housing of armored vehicles, which includes in combination: an inner armor plate, an outer armor plate arranged in spaced relationship to said inner armor plate and having at least portions thereof extending at least approximately parallel to said inner armor plate, a plurality of buffers of rubber material interposed and distributed between said inner and outer armor plates and having a substantially cylindrical portion, a plurality of base plates respectively aligned with said buffers, and connected to said inner armor plate, said buffers having one end connected to their respective adjacent base plates, a plurality of bushings having an inner thread and being respectively aligned with said buffers and coaxially secured therein, a plurality of threaded holding bolts extending through said outer armor plate respectively threadedly engaging said bushings to thereby firmly secure the other end of the respective adjacent buffer to said outer armor plate, thereby preventing the respective pertaining bushing from moving in the axial direction of said cylindrical portion of the respective adjacent buffer and transverse thereto, and elastic metallic reinforcing means embedded in said buffers and extending at an angle relative to the axis of the cylindrical portion of the respective pertaining buffer.

2. A double armor plate in combination according to claim 1, in which the central portion of said base plates is provided with a mushroom-shaped section facing the respective adjacent holding bolt, and in which said buffers are provided with recess means, said mushroom-shaped sections respectively extending into said recess means.

3. A double armor plate in combination according to claim 1, in which said mushroom-shaped sections are provided with a flange, and which includes threaded means securing said flange of said mushroom-shaped sections to the respective adjacent base plates.

4. A double armor plate in combination according to claim 1, in which said buffers within the range of their respective pertaining base plates are provided with a flange-shaped extension, and which includes screw collar ring means for connecting said flange-shaped extension with said inner armor plate.

5. A double armor plate in combination according to claim 1, in which said buffers have their outer surface covered by a non-burnable deformable coat.

6. A double armor plate in combination according to claim 4, which includes flat metallic ring means arranged in said flange-shaped extension of said buffers.

7. A double armor plate in combination according to claim 1, which includes leaf spring means respectively arranged in said buffers and coaxially therewith for reinforcing said buffers.

8. A double armor plate in combination according to claim 7, in which said leaf springs respectively engage said bushings and surround said mushroom-shaped sections in a semi-spherically-shaped manner in radially spaced relationship to said mushroom-shaped sections.

9. A double armor plate in combination to claim 7, in which said leaf springs are individually embedded in said buffers.

10. A double armor plate in combination according to claim 7, in which said leaf springs form a spring cage.

11. A double armor plate in combination according to claim 1, in which said buffers respectively have a conical section located within the region of the respective adjacent bushings.

* * * * *